US007381919B1

(12) United States Patent
Yu et al.

(10) Patent No.: US 7,381,919 B1
(45) Date of Patent: Jun. 3, 2008

(54) LEVER BUTTON OF ELECTRONIC PRODUCT

(75) Inventors: Chih-Chin Yu, Taipei (TW); Chia-Ju Ho, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 11/709,239

(22) Filed: Feb. 22, 2007

(51) Int. Cl.
*H01H 13/70* (2006.01)

(52) U.S. Cl. ..... 200/296; 200/343

(58) Field of Classification Search ..... 200/517, 200/296, 341, 343, 345; 341/22; 345/156, 345/168, 169
See application file for complete search history.

(56) References Cited

U.S. PATENT DOCUMENTS 4,582,967 A * 4/1986 Brumit et al. ..... 200/5 A
5,788,060 A * 8/1998 Kuroda ..... 200/343
6,153,844 A * 11/2000 Hyono et al. ..... 200/343
6,570,111 B2 * 5/2003 Nakagawa et al. ..... 200/343
6,710,275 B2 * 3/2004 Sunadome ..... 200/341
6,964,532 B1 * 11/2005 Lu ..... 400/490
7,041,923 B2 * 5/2006 Lin et al. ..... 200/296
7,071,434 B1 * 7/2006 McConnell et al. ..... 200/310
7,173,205 B2 * 2/2007 Yamamoto ..... 200/343
7,247,806 B2 * 7/2007 Gibbs et al. ..... 200/296
7,276,671 B1 * 10/2007 Wu ..... 200/520

* cited by examiner

*Primary Examiner*—Michael A Friedhofer
(74) *Attorney, Agent, or Firm*—Rabin & Berdo, P.C.

(57) ABSTRACT

A lever button of an electronic product is provided. The lever button is disposed inside a housing, and is deformed under an external force to generate a displacement to press a switch. The lever button includes a fulcrum shaft pivotally disposed in the housing, a pressing section extending from the fulcrum shaft, and at least one suspension arm in the direction opposite to the extending direction of the pressing section. The suspension arm together with the pressing section and the fulcrum shaft forms a lever structure to urge against the housing in the direction opposite to the pressing direction when a user presses the pressing section. The lever button adopts an assembly configuration, and after being assembled, the fulcrum shaft and the suspension arm urge the housing to make the pressing section evenly attached on the housing.

4 Claims, 6 Drawing Sheets

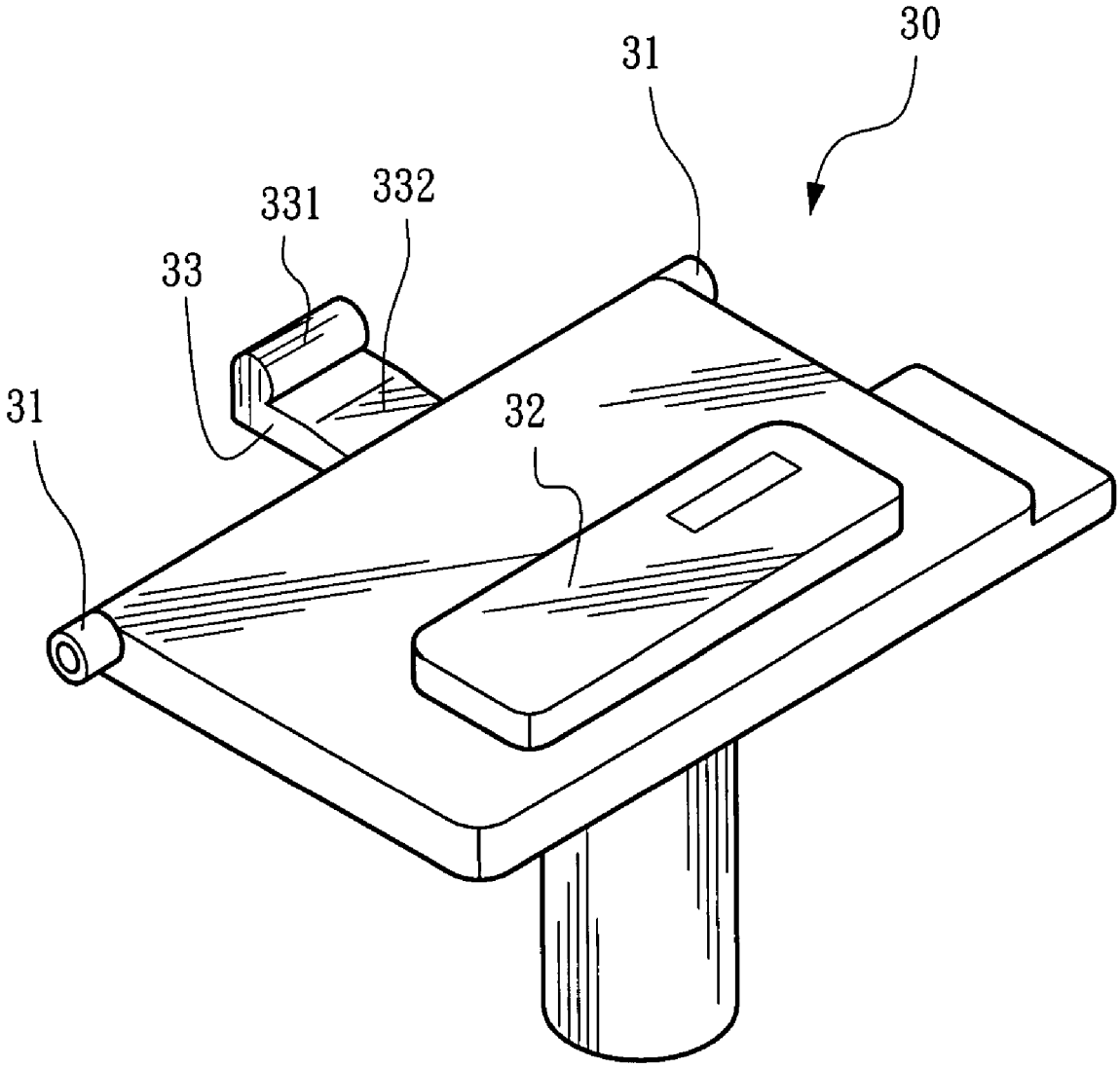
FIR. 2

LEVER BUTTON OF ELECTRONIC PRODUCT

BACKGROUND OF THE INVENTION

1. Field of Invention

The present invention relates to a lever button, and more particularly to a lever button of an electronic product, which uses a lever to rotate to generate a travel range and the travel range can be felt by a user when the user presses the lever button.

2. Related Art

Referring to FIGS. 1A and 1B, a schematic view of the structure and action of a cantilever button of the prior art is shown. A button member 11 of a housing 10 of a conventional electronic product (e.g., a server, notebook computer, etc.) employs a hot melt process to deform a cantilever 12 to form a fixed point, and the cantilever 12 swings with the fixed point as a fulcrum to achieve the action way that a pressing section 13 is pressed downward and recovers automatically. However, this action way has the following defects. The tolerance is difficult to control, the consistency of hot melt is not good, strength is poor, a fixture is needed in course of construction of hot melt, and the materials (including the entire panel and button) cannot be recovered as an error or damage occurs. The feeling of touch differs when pressing down, especially as two points are hot melted, the feeling of touch on left and right sides of the pressing section are different. Buttons cannot be evenly attached onto the panel.

SUMMARY OF THE INVENTION

In view of the above defects, the present invention is directed to providing a lever button that can be evenly attached onto the housing after being assembled, and is capable of providing a touch feeling to the user when the button is pressed down to rotate like a lever.

In order to solve the technological problems, the present invention employs a technology means that provides a lever button of an electronic product, which includes a fulcrum shaft, a pressing section, and at least one suspension arm. The fulcrum shaft is pivotally disposed in the housing of the electronic product. The pressing section extends from the fulcrum shaft in the direction vertical to the pivotal direction of the fulcrum shaft, and rotates about the fulcrum shaft to generate a displacement under a force. At least one suspension arm extends from the fulcrum shaft as well but in the direction opposite to that of the pressing section, such that the suspension arm together with the pressing section and the fulcrum shaft forms a lever structure, so as to eject the housing in an opposite direction when the user presses the pressing section.

The present invention can be further improved by disposing a plurality of symmetrical suspension arms to acquire a balanced feedback torque force when the width of the button is large and it is the edge that is pressed.

The present invention is advantageous in that the design of the fulcrum shaft and the extending arm is adopted, the fulcrum shaft is pivotally disposed serving as fulcrum, and the ejecting arm urges against the inside of the housing, such that the button can be evenly attached onto the panel and the feeling of touch by the user is kept the same. Also, it can be assembled without using the hot melt process, and the panel and the button can be recovered as a failure occurs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein:

FIG. 2 is an isometric view of a lever button according to an embodiment of the present invention;

DETAILED DESCRIPTION OF THE INVENTION

Figure 1A:
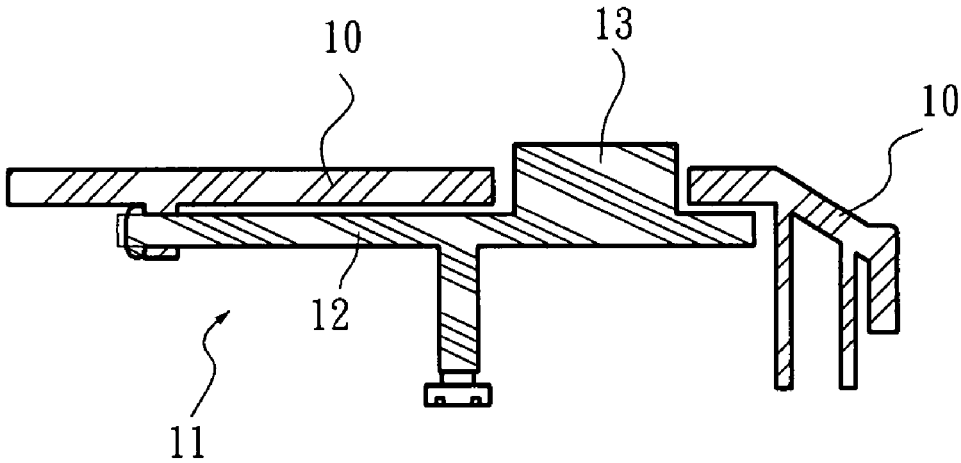
FIG. 1A (PRIOR ART)
FIGS. 1A and 1B are schematic views of the structure and action of a cantilever button of the prior art.
Figure 1B:
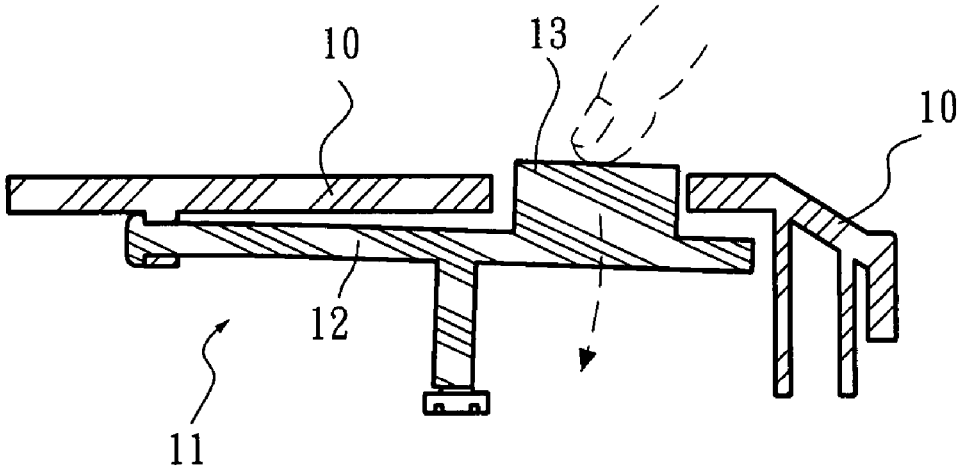
FIG. 1B (PRIOR ART)

The preferred embodiments of the present invention will be illustrated in detail below with the accompanied drawings.

First, referring to FIG. 2, an isometric view of a lever button according to the embodiment of the present invention is shown. The lever button 30 includes a fulcrum shaft 31, a pressing section 32, and at least one suspension arm 33. The fulcrum shaft 31 is pivotally connected to the inner side of a housing 21 (in FIGS. 5 and 6) of an electronic product 20. The pressing section 32 extends vertically from the fulcrum shaft 31 in the direction same as the axial direction of the pivotal axis of the fulcrum shaft 31. The pressing section includes a pressing button that is positionable in the opening, and a pressing plate having an upper surface that is located in a single plane. The pressing button is disposed on the pressing plate. The suspension arm 33 also extends from the fulcrum shaft 31 in the direction opposite to the extending direction of the pressing section, such that the suspension arm 33, the pressing section 32, and the fulcrum shaft 31 form a lever structure having a moment arm that intersects the pressing button and that is perpendicular to the pivotal axis of the fulcrum shaft.

Figure 3A:
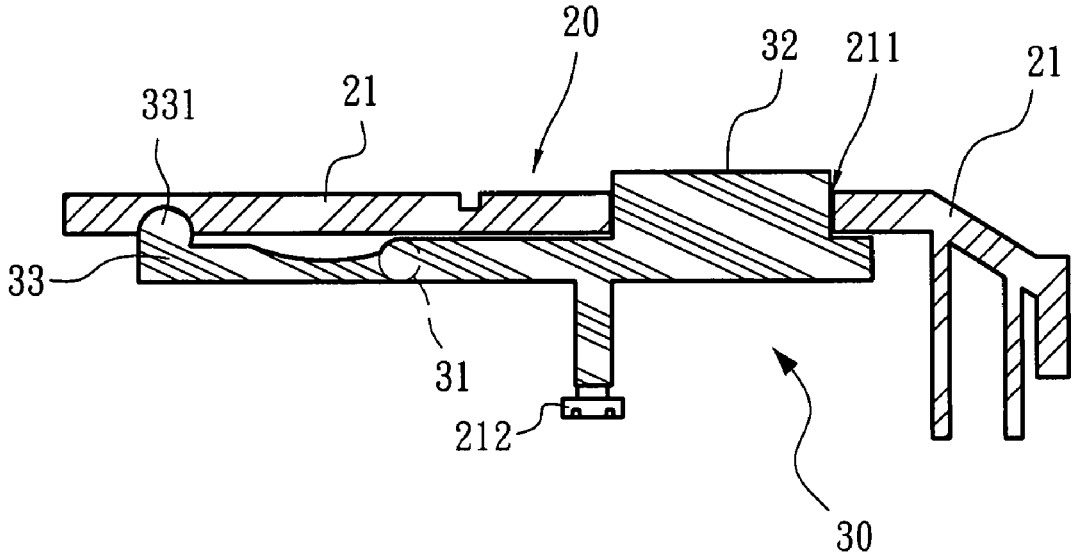
FIG. 3A is a sectional view of an embodiment of the present invention.
Figure 3B:
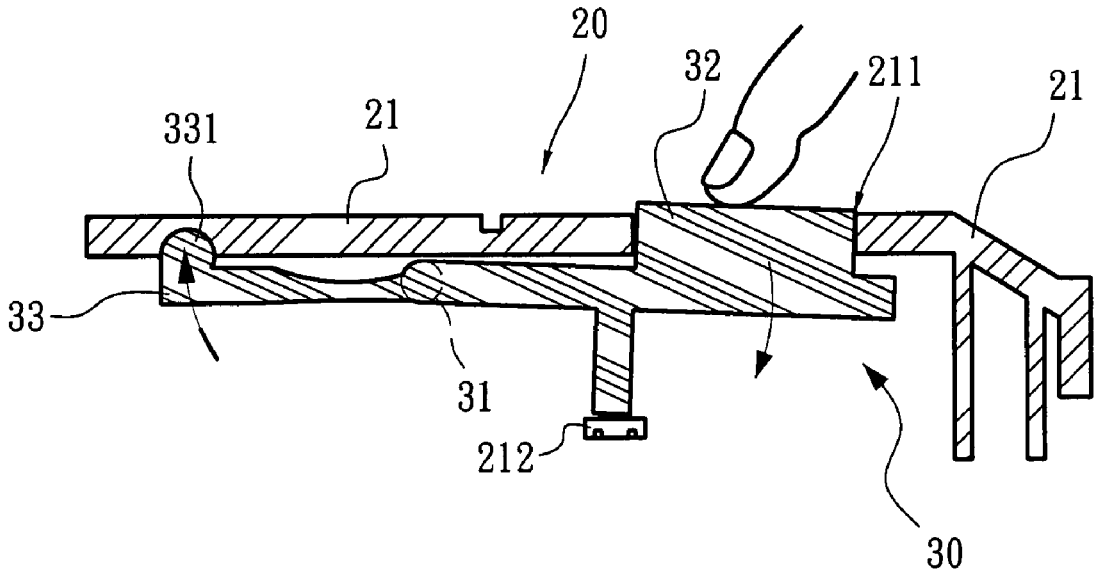
FIG. 3B is a schematic view of the action according to an embodiment of the present invention of FIG. 3A.

FIG. 3A is a schematic cross-sectional view of the embodiment of the present invention, and FIG. 3B is a schematic view of the action according to the embodiment of the present invention. With the above structure, after the lever button 30 is pivotally disposed in the housing 21 of the electronic product 20 by the use of the fulcrum shaft 31, the pressing section 32 is placed between an opening 211 of the housing 21 and a switch 212 inside the opening 211 of the housing 21. Thus, the pressing section 32 when being pressed by a user rotates like a lever with the fulcrum shaft 31 as the fulcrum, so as to generate a rotation action. Meanwhile, the suspension arm 33 urges against the housing 21 in the direction opposite to the pressing direction to produce a restoring force of the pressing section 32, such that when the user releases the pressing force, the button returns to the original position.

Referring to FIG. 3A, a flange or a protrusion 331 of a bump can be placed on the suspension arm 33, so as to slidingly press against and urge against the inner side of the housing 21 exactly. The adding of the protrusion 311 is characterized by when the lever button 30 is assembled in the housing 21, using the fulcrum shaft 31 placed in the housing 21 to form the fulcrum based on the lever principle, so that the suspension arm 33 at the tail end urges against the inner surface of the housing 21 to make the pressing section 32 at the head end produce the internal stress to tilt up. Thus, the button can be evenly attached onto the inner side of the housing 21 to prevent the pressing section 32 at the head end from hanging down during the assembling.

Furthermore, a structure of a neck portion 332 can also be placed at a middle section of the extending section of the suspension arm 33 which extends from the fulcrum shaft 31, so as to concentrate the deformation stress of the lever on this section to achieve the consistent counterforce every time pressing. At the same time, with the proper design of the neck portion 332, the user has different feelings of soft and hard pressing. For example, when the neck portion 332 is designed to be wide, the pressing force must be larger, and the feedback force is hard. Whereas, when the neck portion 332 is designed to be narrow, the feedback force is softer, and only a small pressing force is sufficient to press the switch 212. Definitely, if the neck portion 332 is designed to be narrow, the problems such as strength and durability must be taken into account.

Figure 4:
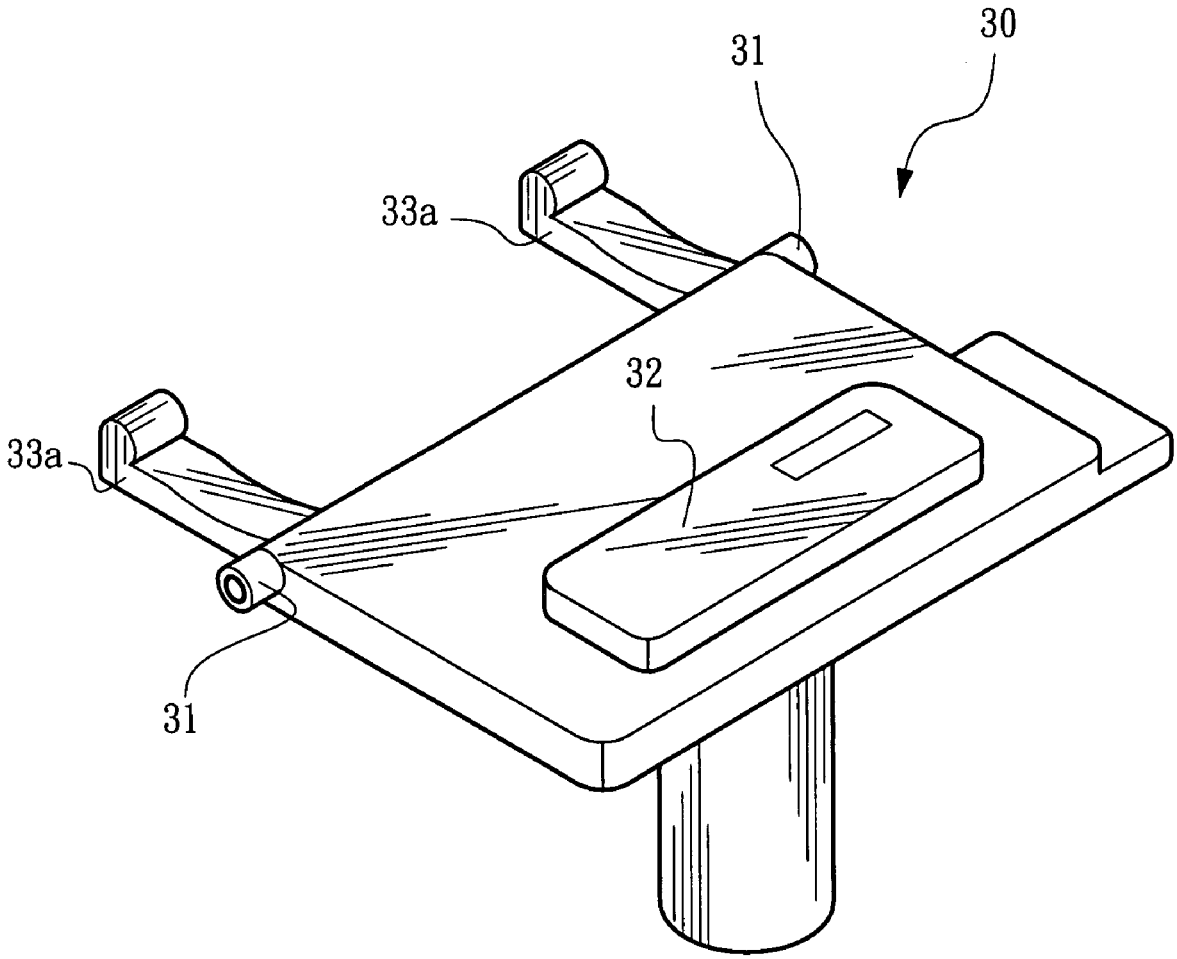
FIG. 4 is an isometric view of another embodiment of the present invention.

Referring to FIG. 4, an isometric view of another embodiment of the present invention is shown. The lever button 30 can be provided with two sets of suspension arm 33*a* which extend from the fulcrum shaft 31 and is disposed symmetrically about the pressing section 32, so as to provide the pressing section 32 with more balanced feedback force. Especially for the large-area, soft and wide pressing section 32, when the user presses the corner of the pressing section 32, a consistent feedback is provided to form a uniform pressing feeling.

Figure 5:
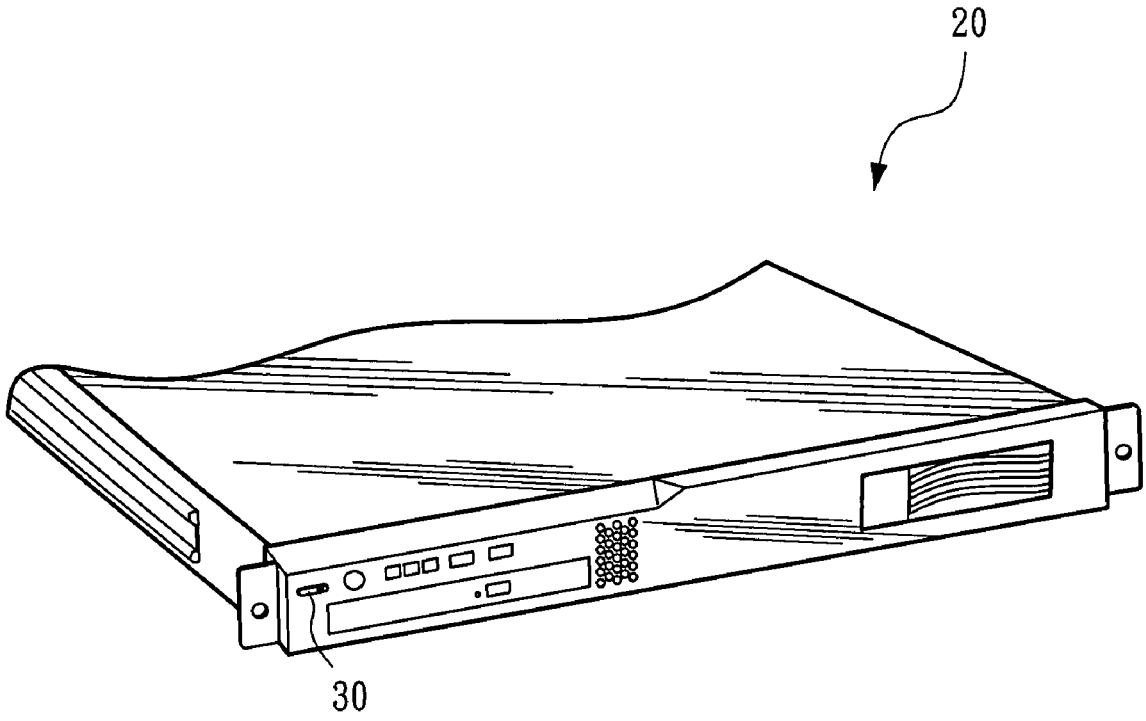
FIG. 5 is an isometric view of an embodiment of the present invention when applied to a frame panel.
Figure 6:
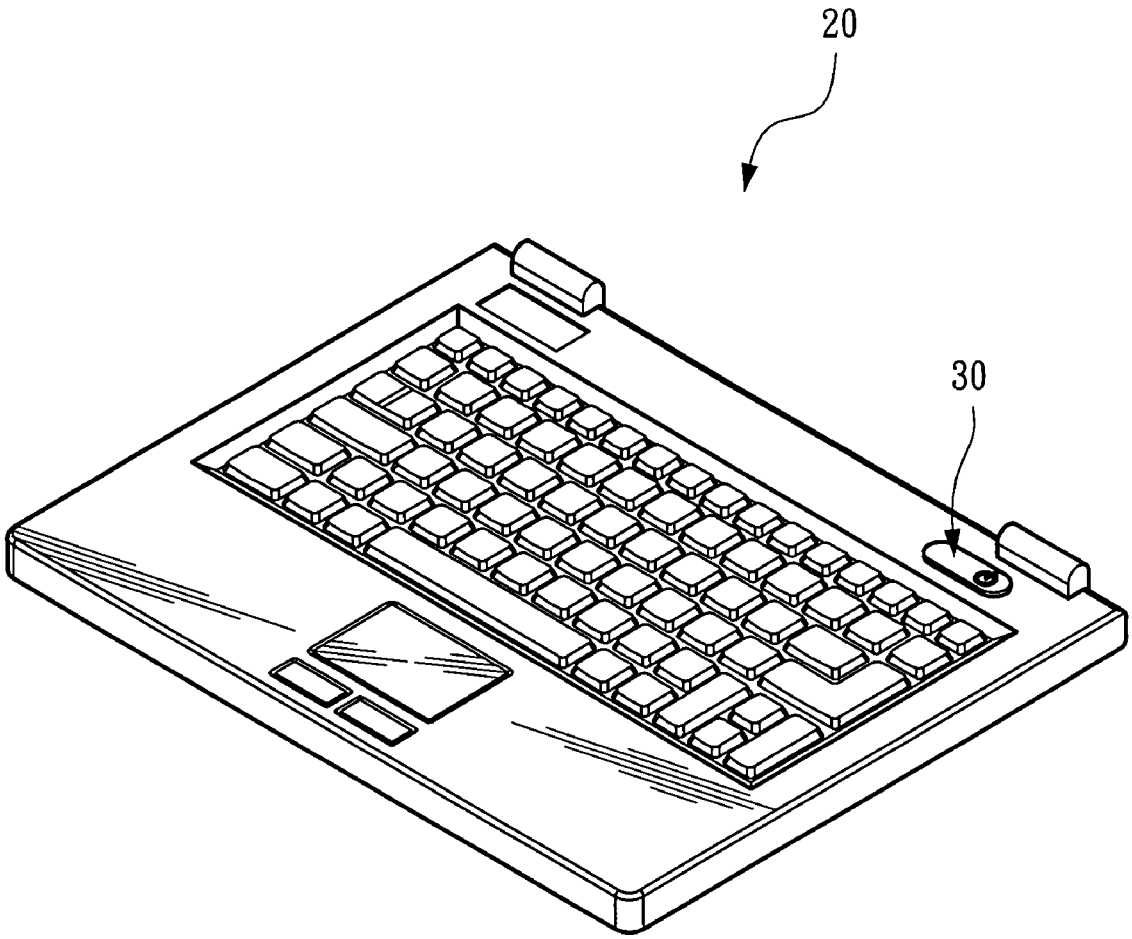
FIG. 6 is an isometric view of an embodiment of the present invention when applied to a notebook computer.

FIG. 5 is an isometric view of an embodiment of the present invention when applied to the frame panel, and FIG. 6 is an isometric view of an embodiment of the present invention when applied to a notebook computer. An electronic product 20 in the present invention refers to the frame server or notebook computer. Definitely, the present invention is not limited, and can also be used to the electronic products such as desk computers, portable computers, mobile phones.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lever button of an electronic product that comprises a housing, an opening formed in the housing, and a switch disposed under the opening, the lever button being placed between the opening and the switch, so that the switch is displaced when a user presses the lever button toward the switch, the lever button comprising:

a fulcrum shaft, pivotally disposed in the housing;

a pressing section, horizontally extending from one side of the fulcrum shaft and being located between the switch and the opening, the pressing section including a pressing button positionable in the opening, and a pressing plate having an upper surface that extends from the fulcrum shaft to under the pressing button, the upper surface being located in a single plane, the pressing button extending in a direction vertical to a direction of a pivotal axis of the fulcrum shaft, so that the switch is displaced when the user presses the pressing button; and at least one suspension arm, disposed on another side of the fulcrum shaft, and extending in a direction opposite to the extending direction of the pressing section, so that the suspension arm together with the pressing section and the fulcrum shaft form a lever structure having a moment arm that intersects the pressing button and that is perpendicular to the pivotal axis of the fulcrum shaft, the suspension arm including at least one protrusion that protrudes in a direction towards the housing, and presses against the housing to urge against the housing in a direction opposite to a pressing direction when the user presses the pressing button.

2. The lever button of the electronic product as claimed in claim 1, wherein the suspension arm further comprises a neck portion at a middle section.

3. The lever button of the electronic product as claimed in claim 1, wherein the lever button comprises two suspension arms symmetrical about the pressing section.

4. A lever button of an electronic product that comprises a housing, an opening formed in the housing, and a switch disposed under the opening, the lever button being placed between the opening and the switch, so that the switch is displaced when a user presses the lever button toward the switch, the lever button comprising:

a fulcrum shaft, pivotally disposed in the housing;

a pressing section, horizontally extending from one side of the fulcrum and being located between the switch and the opening, the pressing section including a pressing button positionable in the opening, and a pressing plate having an upper surface that extends from the fulcrum shaft to under the pressing button, the upper surface being located in a single plane, the pressing button extending in a direction vertical to a direction of a pivotal axis of the fulcrum shaft, so that the switch is displaced when the user presses the pressing button; and at least one suspension arm, disposed symmetrically about the pressing section and on another side of the fulcrum shaft, and extending in a direction opposite to the extending direction of the pressing section, so that the suspension arm together with the pressing section and the fulcrum shaft forms a lever structure having a moment arm that intersects the pressing button and that is perpendicular to the pivotal axis of the fulcrum shaft, wherein the suspension arm including at least one protrusion that protrudes in a direction towards the housing, and presses against the housing to urge against the housing in a direction opposite to a pressing direction when the user presses the pressing button.

* * * * *